United States Patent [19]

Rosati

[11] Patent Number: 4,669,720

[45] Date of Patent: Jun. 2, 1987

[54] EJECTOR UNIT FOR MACHINES FOR HANDLING SIGNATURES AND SIMILAR ARTICLES, PARTICULARLY FOR SIGNATURE-STACKING MACHINES

[75] Inventor: Domenico Rosati, Turin, Italy

[73] Assignee: R.O.M. S.r.l., Turin, Italy

[21] Appl. No.: 839,217

[22] Filed: Mar. 13, 1986

[30] Foreign Application Priority Data

Mar. 20, 1985 [IT] Italy ..... 53158/85[U]

[51] Int. Cl.[4] ..... B65H 7/00

[52] U.S. Cl. ..... 271/256; 271/182; 271/188; 271/189; 271/209

[58] Field of Search ..... 271/161, 182, 183, 188, 271/209, 256, 189

[56] References Cited

U.S. PATENT DOCUMENTS

| | | | |
|---|---|---|---|
| 3,948,153 | 4/1976 | Dutro et al. | 271/189 |
| 3,998,141 | 12/1976 | Hsiue | 271/182 |
| 4,073,223 | 2/1978 | Crawford | 271/182 |
| 4,359,217 | 11/1982 | Roller et al. | 271/188 |

*Primary Examiner*—H. Grant Skaggs

*Attorney, Agent, or Firm*—Morgan & Finnegan

[57] ABSTRACT

An ejector unit for machines for handling signatures and similar flat articles comprises a first rotary body defining the output end of a conveyor on which a substantially continuous flow of articles to be handled is fed, a stop member selectively orientable between a rest position and an operating position in which the member stops the flow of articles adjacent the output end of the conveyor, and two second rotary bodies which can be rotated by the first rotary body to carry out a shaping (ribbing) action on the articles handled. Third rotary bodies interposed between the first rotary body and one of the second rotary bodies are movable between a first operating position in which motion is transmitted from the first rotary body to the second rotary bodies and a second operating position in which the transmission of rotary movement between the first rotary body and the second rotary bodies is prevented. An actuator is interposed between the stop member and the third rotary bodies and can cause the movement of the third rotary bodies to the second operating position when the stop member is oriented in its operating position.

6 Claims, 2 Drawing Figures

Figure 1:
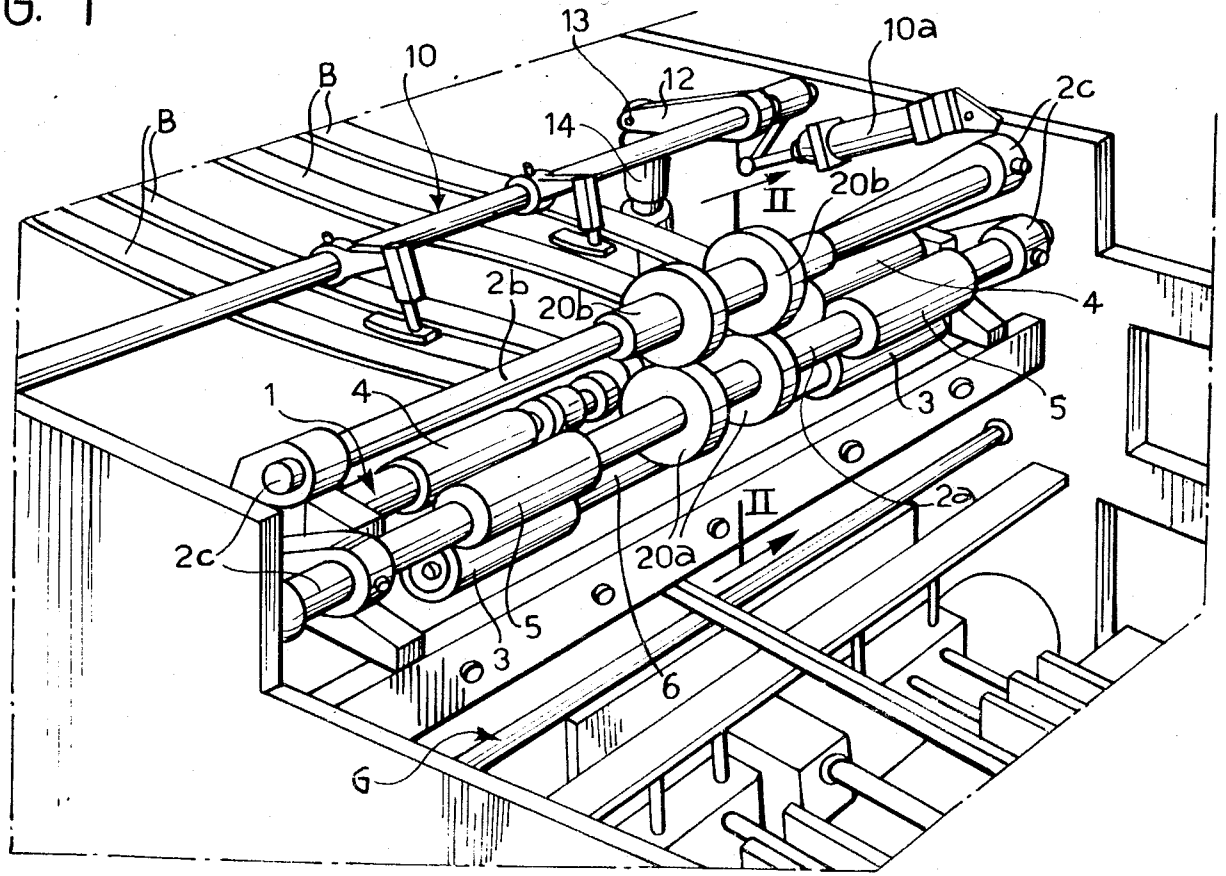

EJECTOR UNIT FOR MACHINES FOR HANDLING SIGNATURES AND SIMILAR ARTICLES, PARTICULARLY FOR SIGNATURE-STACKING MACHINES

The present invention relates to ejector units for machines for handling signatures and similar flat articles (for example, quires of paper, booklets, etc.).

In a typical configuration of use, such units are mounted immediately upstream of the stacking stand in machines for stacking signatures. The ejector unit in this case has the function of feeding the signatures which flow continuously on a conveyor, typically a belt conveyor, regularly to the stand and also of carrying out a transverse shaping action (ribbing) on the signatures, preventing them from bending and falling into the stacking stand in a disordered manner. The ejector unit is normally provided with a stop member which is able to interrupt the flow of signatures momentarily, for example to allow the removal of a pile of signatures from the stand once it is formed.

The term ejector unit, as used in the present description and in the following claims, however, should also be considered as extending to all those devices which can achieve similar functions (ordering and temporary stoppage of the flow, transverse folding, etc.) in any machine for handling signatures and like articles.

Known ejector units typically include at least one first rotary body defining the output end of a conveyor on which a substantially continuous flow of articles to be handled is fed, a stop member which can be oriented selectively between a rest position and an operating position in which the member itself stops the flow of articles adjacent the output end of the conveyor, and at least one second rotary body which can be rotated by the at least one first rotary body to carry out a shaping (ribbing) action on the articles handled.

The ejector units of the type specified above, made in accordance with the prior art, usually have a functional drawback which seriously limits their effectiveness in use: when the stop member is lowered onto the conveyor into its operating position so as to stop the flow of articles, those articles (signatures) which are close to the output end of the conveyor, and particularly the article which is first in line in the row of articles temporarily stopped, are exposed to the action of the second rotary body (ribbing roller) which continues to rotate since it is driven by the first rotary body (output of the conveyor). This means that the articles are subject to intense rubbing by the profiled surface of the ribbing roller. The rubbing is extremely harmful, particularly when — in a typical configuration of use of the ejector unit — the upper face of the articles (signatures) exposed directly to the rubbing are printed with characters and the ink is still fresh. The rubbing roller thus blurs the printed characters, making it necessary to discard the signature in many cases.

The object of the present invention is to provide an ejector unit of the type specified above which avoids the aforesaid disadvantage, thus increasing the practicality and efficiency of the unit in use.

According to the present invention, this object is achieved by virtue of the fact that at least one third rotary body is interposed between the at least one first rotary body and the at least one second rotary body, and is movable between a first operative position in which the third rotary body transmits rotary motion from the first rotary body to the second rotary body and a second operating position in which the transmission of rotary movement between the first rotary body and the second rotary body is prevented, and in that actuator means are interposed between the stop member and the at least one third rotary body and can cause the movement of the at least one third rotary body to the second operating position when the stop member is oriented in its operating position.

In the ejector unit according to the invention, therefore, the rubbing of the signatures by the ribbing roller during the periods of temporary stoppage of the flow of signatures is avoided by the temporary stoppage of the rotation of the ribbing roller.

Figure 2:
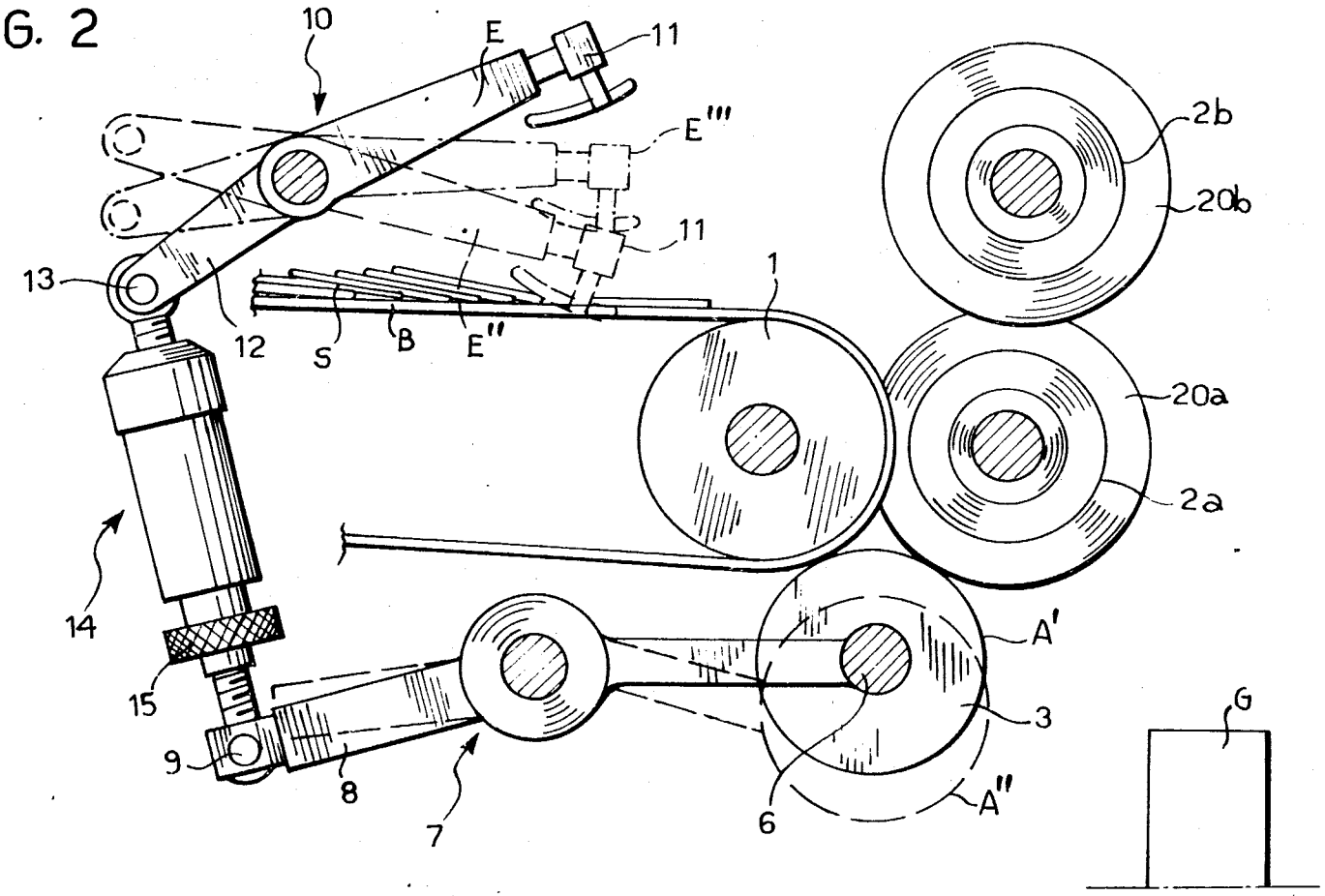

Further characteristics and advantages of the invention will become apparent from the description which follows, given purely by way of non-limiting example with reference to FIGS. 1 and 2 of the appended drawings, in which:

FIG. 1 is a general perspective view of an ejector unit according to the invention, and FIG. 2 is a side elevational view corresponding approximately to a section taken on the line II—II of FIG. 1.

FIGS. 1 and 2 relate to an ejector unit mounted on a machine for stacking signatures immediately upstream of the stacking stand, generally indicated G.

A roller (or pulley system) with a horizontal axis (first rotary body)is indicated 1, over which pass a plurality of belts B whose upper passes define a conveying plane of a conveyor on which a continuous flow of signatures S or similar flat articles (quires of paper, booklets, etc.) is fed (in a direction from left to right with reference to the situation illustrated in FIG. 2).

A roller 2*a* (second rotary body) is mounted parallel to and adjacent the roller 1 on the side thereof facing the stacking stand G.

Above the roller 2*a* is a further roller 2*b*.

The superposed rollers 2*a* and 2*b* (second rollers) together define a slot which lies in a horizontal plane substantially corresponding to the plane defined by the upper passes of the belts B. Consequently, the signatures S ejected from the conveyor, the output end of which is defined by the roller 1, pass through this first slot and fall into the stacking stand G.

In known manner, the rollers 2*a* and 2*b* have annular projections 20*a* and 20*b* which interdigitate and are thus able to act as ribbing rollers to perform the transverse shaping action on the signatures S before they are fed to the stand G.

These rollers 2*a*,2*b* are connected together by a transmission (for example, a gear transmission, generally indicated 2*c* in FIG. 1) which achieves the synchronised rotation of the two rollers in opposite senses.

The ejector unit of the invention differs from prior art ejector units in which the ribbing rollers are driven continuously by the roller for conveying the signatures, in that the transmission of rotary movement between the roller 1 defining the output end of the conveyor on which the signatures move and the ribbing rollers 2*a*, 2*b* is achieved through a pair of wheels or rubberised rollers (third rollers) 3 located at the opposite ends of the rollers 1 and 2*a*.

As best seen in FIG. 1, sleeves 4, 5 of a material whose surface has a considerable resistance to sliding (for example, plastics material with a corrugated surface) are mounted on the ends of the rollers 1 and 2*a*.

The rollers 3 are mounted on a shaft 6 located at one end of a lever mechanism 7 (FIG. 2) which has central pivot points (fulcra) located at the sides of the frame of the machine on which the ejector unit is mounted. The movement of the mechanism 7 is driven by a pivoted arm 8 having a driving end 9.

The rollers 3 are moved between first and second operating positions, illustrated in full outline and in broken outline respectively in FIG. 2

In the first operating position (indicated A'), the rubberised rollers 3 bear on the friction sleeves 4 and 5 of the shafts 1 and 2*a* and thus transmit rotational movement from the roller 1 to the ribbing rollers 2*a* and 2*b*.

In the second position (indicated A''), the rollers 3 are spaced from the roller 1 and the roller 2*a* so that movement is not transmitted from the roller 1 to the rollers 2*a* and 2*b*.

The pivoting of the lever mechanism 7, which causes the movement of the rollers 3 from the position A' to the position A'' and vice versa, is caused by at least one stop member 10. The operation of the member 10 is such as temporarily to stop the advance of the signatures S on the conveyor, preventing them from falling into the stacking stand G so that a pile of signatures just formed can be removed.

More particularly, the operating member 10 is movable between a rest position E' (illustrated in full outline in FIG. 2) in which the active end of the member 10, indicated 11, is raised relative to the upper passes of the belts B and does not interfere with the movement of the signatures S, and an operative position E'' (illustrated in broken outline in FIG. 2) in which the active end 11 presses on the signatures which are on the upper passes of the belts B and stops their advance towards the ribbing rollers 2*a* and 2*b*.

The stop member 10 also has a generally lever configuration and is pivoted at an intermediate position on the framework of the apparatus on which the ejector unit is mounted.

In known manner, the movement of the member 10 is driven by a pneumatic jack 10*a* (FIG. 1). The member 10 has an operating arm 12 with a driving end 13 which overlies the driving end 9 of the arm 8. Between the driving ends 9 and 13 is a transmission arm 14 which extends approximately vertically and can contract resiliently in a longitudinal direction. Typically, the arm 14 is constituted by a spring inserted within a telescopic sheath and provided with an adjustment nut 15 which allows the resistance of the spring to the longitudinal compressive thrust to be controlled.

The lever members 7 and 10 and the transmission arm 14 interposed between them constitute a lever mechanism which allows the movement of the rollers 3 to be controlled by the movement of the active end 11 of the stop member.

More particularly, when the stop member 10 is in the rest position E' with the active end 11 raised, the driving end 13 pushes the spring 14 downwardly to cause the lowering of the driving end 9 of the member 7. Consequently, the rollers 3 are thrust upwardly into the position of engagement A' with the roller 1 and the roller 2*a*, ensuring the transmission of movement between the roller 1 and the ribbing rollers 2*a* and 2*b*.

Here one is dealing with the normal operating condition of the ejector unit, in which the signatures S are expelled from the output end of the conveyor constituted by the belts B, pass through the slot defined between the rollers 2*a*, 2*b*, and then fall into the stacking stand G after having been subjected to the ribbing action.

When the actuator 10*a* is actuated, the stop member 10 is pivoted so as to bring the end 11 into the position E'' to stop the flow of signatures towards the stacking stand G, the driving end 13 being raised and causing the simultaneous raising of the driving end 9. The rollers 3 are brought into the second operating position A'' in which they are spaced from the rollers 1 and 2*a*.

The transmission of movement from the roller 1 to the rollers 2*a* and 2*b* is thus prevented and the ribbing rollers 2*a* and 2*b* stop. The signatures S which extend between them at that moment are thus not subject to any harmful rubbing which could cause blurring of the characters imprinted thereon.

As the stop member 10 is returned to the rest position E'', the end 13 is lowered again, causing the simultaneous lowering of the end 9 and the return of the rollers 3 to the position A'.

The subservience of the movement of the rollers 3 to the stop member 10 could also be achieved by means of a rigid transmission rod.

In the ejector unit according to the invention, however, a longitudinally resilient arm constituted by the spring 14 is used. The relaxed length of the spring 14 and its elastic constant are chosen and regulated so that the rollers 3 reach the position A' (transmission of movement between the roller 1 and the rollers 2*a* and 2*b*) when the stop member 10 is in an intermediate position (illustrated by chain lines and indicated E''' in FIG. 3) between the operating position E'' and the rest position E'. The result is that, in the first portion of the orienting travel of the member 10 from its operating position to its rest position (the portion of the path between the positions E'' and E''' of FIG. 2), there is a corresponding movement of the rollers 3 from the position A'' to the position A'. The subsequent portion of the return path to the rest position (the portion of the path between the angular positions E''' and E' of FIG. 3) has no corresponding movement of the rollers 3: the final pivoting of the member 10 to the rest position E' therefore has the effect of causing the longitudinal compression of the spring 14 and consequently of establishing a resilient force which urges the driving end 9 downwardly and presses the rollers 3 against the rollers 1 and 2*a*.

The magnitude of this force may be adjusted by means of the ring 15, thus achieving precise control of the transmission of rotational movement between the roller 1 and the ribbing rollers 2*a*, 2*b* without the need for complex adjusting operations.

The presence of the compressed spring 14 thus facilitates the return of the stop member 10 to the operating position E''.

What is claimed is:

1. Ejector unit for machines for handling signatures and similar flat articles, comprising at least one first rotary body defining the output end of a conveyor on which a substantially continuous flow of articles to be handled is fed, a stop member selectively orientable between a rest position and an operating position in which the member stops the flow of articles adjacent the output end of the conveyor, and at least one second rotary body, which can be rotated by said at least one first rotary body to carry out a shaping action on the articles handled, wherein at least one third rotary body is interposed between said at least one first rotary body and said at least one second rotary body and is movable between a first operating position in which the third rotary body transmits rotary motion from the first rotary body to the second rotary body and a second operating position in which the transmission of rotary movement between the first rotary body and the second rotary body is prevented, and wherein actuator means are interposed between the stop member and said at least one third rotary body and can cause the movement of said at least one third rotary body to the second operating position when the stop member is oriented in its operative position.

2. Ejector unit according to claim 1, including two second rotary bodies constituted by two profiled contrarotating parallel rollers defining a slot between them through which pass the articles handled, one of the contrarotating rollers being driven by the at least one first rotary body when the at least one third rotary body is in the first operating position.

3. Ejector unit according to claim 1, wherein said at least one first rotary body and said at least one second rotary body between which said at least one third rotary body is interposed are constituted by parallel rollers which are side by side and each have two facing ends, and wherein two third rotary bodies are provided each of which can transmit movement between two corresponding facing ends of said parallel adjacent rollers when in the first operating position.

4. Ejector unit according to claim 3 wherein, at their facing ends,said parallel rollers have surfaces coated with a friction material which can cooperate with the third rotary bodies.

5. Ejector unit according to claim 1, wherein the actuator means include a lever mechanism with a resilient arm which, when the stop member is oriented into its rest position, is resiliently loaded and forces the at least one third rotary body into the first operating position.

6. Ejector unit according to claim 5, wherein the lever mechanism comprises essentially:

a first pivoted arm which is orientable with the stop member and has a driving end, a second pivoted arm which controls the movement of the at least one third rotary body and has a respective driving end, and a longitudinally resilient transmission arm interposed between the driving ends of the first and second pivoted arms; the arrangement being such that the orienting path of the stop member from the operating position to the rest position comprises two consecutive portions in which, respectively:

(i) the movement of the first pivoted arm produces a corresponding movement of the second pivoted arm and the movement of the at least one third rotary body into the first operating position, and (ii) the movement of the first pivoted arm proceeds while the second pivoted arm remains in a fixed position as a result of the disposition of the at least one third rotary body in the first operating position, whereby the transmission arm is resiliently loaded to generate a force which maintains the at least one third rotary body in the first operating position.

* * * * *